US007648331B2

(12) United States Patent
Spakovszky et al.

(10) Patent No.: US 7,648,331 B2
(45) Date of Patent: Jan. 19, 2010

(54) SPIRAL AIR INDUCTION

(75) Inventors: Zoltan Spakovszky, Cambridge, MA (US); Christian Roduner, Baden (CH)

(73) Assignee: ABB Turbo Systems AG, Baden (CH)

( * ) Notice: Subject to any disclaimer, the term of this patent is extended or adjusted under 35 U.S.C. 154(b) by 139 days.

(21) Appl. No.: 11/865,837

(22) Filed: Oct. 2, 2007

(65) Prior Publication Data

US 2008/0038112 A1 Feb. 14, 2008

Related U.S. Application Data

(63) Continuation of application No. PCT/CH2006/000171, filed on Mar. 22, 2006.

(30) Foreign Application Priority Data

Apr. 4, 2005 (EP) ..... 05405278.2

(51) Int. Cl.
*F04D 29/44* (2006.01)

(52) U.S. Cl. ..... 415/1; 415/57.1; 415/208.3; 415/914

(58) Field of Classification Search ..... 415/1, 415/208.3, 208.4, 914, 57.1, 57.3, 57.4, 58.2, 415/58.3, 58.4
See application file for complete search history.

(56) References Cited

U.S. PATENT DOCUMENTS

| | | | | |
|---|---|---|---|---|
| 2,052,869 | A | | 9/1936 | Coanda |
| 2,656,096 | A | * | 10/1953 | Schwarz ..... 415/58.4 |
| 4,131,389 | A | | 12/1978 | Perrone et al. |

FOREIGN PATENT DOCUMENTS

| | | |
|---|---|---|
| CH | 204 331 | 8/1939 |
| DE | 1 096 536 | 1/1961 |
| EP | 0 280 205 (A2) | 8/1988 |
| FR | 963540 | 7/1950 |
| GB | 775784 | 5/1957 |

OTHER PUBLICATIONS

English language version of Form PCT/ISA/237 (Written Opinion of the International Searching Authority).

(Continued)

*Primary Examiner*—Christopher Verdier
(74) *Attorney, Agent, or Firm*—Buchanan Ingersoll & Rooney PC

(57) ABSTRACT

The nozzles are in the form of blowing-in openings in the housing wall which bounds the flow channel. The blowing-in openings are fed directly by means of air which is extracted from the flow channel downstream from the diffusor. This air is at a higher pressure than the flow in the flow channel upstream of the diffusor. This results in a passive, dynamic stabilization system for a compressor stage in the high pressure-ratio range, which does not require any additional control or actuating elements.

11 Claims, 2 Drawing Sheets

OTHER PUBLICATIONS

Form PCT/IB/373 (International Preliminary Report on Patentability, Chapter 1) dated Oct. 23, 2007.

Form PCT/ISA/210 (International Search Report) dated Aug. 3, 2006.

Form PCT/ISA/237 (Written Opinion of the International Searching Authority, non-English version) dated Aug. 3, 2006.

European Search Report dated Oct. 21, 2005 (with English translation of category of cited documents).

Gary J. Skoch, "Centrifugal Compressor Flow Range Extension Using Diffuser Flow Control", NASA Glenn Research Center, Cleveland, Ohio, Dec. 5, 2000, 17 pages, Army Research Laboratory, Vehicle Technology Directorate, Cleveland, Ohio (cited on p. 3 of the specification).

* cited by examiner

SPIRAL AIR INDUCTION

RELATED APPLICATIONS

This application claims priority under 35 U.S.C. §119 to EP Application 05405278.2 filed in Europe on Apr. 4, 2005, and as a continuation application under 35 U.S.C. §120 to PCT/CH2006/000171 filed as an International Application on Mar. 22, 2006, designating the U.S., the entire contents of which are hereby incorporated by reference in their entireties.

TECHNICAL FIELD

An apparatus is disclosed for blowing air into the flow channel of a radial compressor.

BACKGROUND INFORMATION

In order to widen the family of characteristics for radial compressor stages, stabilizers are used in the induction area of the compressor wheel in a multiplicity of the latest generations of radial compressor stages.

The market demand for ever higher pressure ratios in compressors of exhaust-gas turbochargers is never-ending. However, the process of increasing the pressure ratio by increasing the rotation speed without changing the compressor stage design is subject to limits, since the surge limit and choke limit, which limit the useful range of characteristics, converge as the rotation speed increases. The useful range of characteristics therefore decreases continuously in the direction of higher pressure ratios. In order to counteract this and to keep the useful range of characteristics as broad as possible even at high pressure ratios, it is possible to use a diffusor with a smaller flow cross section, while the compressor wheel design remains the same and the compressor wheel size is not changed. The surge limit is thus shifted in the direction of lower volume flows, resulting in a wider useful range of characteristics without changing the wheel choke limit. One disadvantage in this case is that the efficiency is reduced, particularly when on partial load. This disadvantage can be avoided by using appropriate measures to increase the stability of the given compressor stages at maximum load. This can be achieved by blowing air in, on the housing side, into the flow channel in the intermediate area, where there are no blades, between the rotor blades of the compressor wheel and the guide vanes of the diffusor. The dynamic stability in the region of high pressure ratios can be increased by blowing in air.

Another possible way to increase the pressure ratio and to avoid convergence of the surge limit and choke limit is adaptation of the compressor wheel design. The stability and therefore the useful range of characteristics can be achieved by increasing the "backsweep" of the compressor wheel. The "backsweep" denotes the angle at the compressor wheel outlet between a blade with a radial trailing edge and one with an outlet angle which is positioned at a flatter angle in the tangential direction, in the opposite direction to the wheel rotation direction. The increase in the "backsweep" results in the need to increase the wheel circumferential speed in order to achieve the same pressure ratio. It is therefore necessary to increase the rotation speed more than proportionally in order to achieve a higher pressure ratio. However, this is limited by the compressor wheel material limits, or a change must be made to a material with better mechanical characteristics. Materials such as these are considerably more expansive. In comparison to this solution, the process of blowing air in has cost advantages, since an existing compressor stage is suitable for achieving higher pressure ratios, and there is no need for a costly change in the material of the compressor wheel.

"Centrifugal Compressor Flow Range Extension using Diffusor Flow Control", (Gary J. Skoch; Army Research Laboratory, Vehicle Technology Directorate, Cleveland, Ohio; Dec. 5, 2000) discloses a radial compressor with a downstream diffusor, in which compressed air is blown in the flow direction into the flow channel between the compressor wheel and the diffusor, using the Coanda effect nozzles.

In the Coanda effect (described in U.S. Pat. No. 2,052,869) is a flow effect on the basis of which a rapidly flowing fluid (gas or liquid) which is flowing along a surface of a solid body adheres to the surface of this body and is not separated from the surface.

The compressed air nozzles are arranged in the housing wall which bounds the flow channel, and are firmly screwed to the compressor housing. They can move within the openings, so that the induction direction can be varied. The nozzles are connected via a pipeline to an external compressed-air supply.

CH 204 331 discloses a device for preventing jet separation in compressors. In this case, parts of the flow are sucked away through extraction openings in the area of the guide wheels, and are then fed back into the flow again, further upstream. In this case, the flow is reintroduced by means of circumferential slots, in the form of nozzles, aligned in the flow direction.

SUMMARY

The object of the disclosure is to provide a simplified, cost-effective apparatus for blowing air into the flow channel of a radial compressor, which in particular can be fitted with little effort and is highly reliable in operation.

In the apparatus according to the disclosure, the nozzles are in the form of blowing-in openings in the housing wall which bounds the flow channel. The blowing-in openings are fed directly with air extracted from the manifold cavity downstream from the diffusor. This air is at a higher pressure than the flow in the flow channel upstream of the diffusor.

This results in a passive, dynamic stabilization system for a commercial stage in the high pressure-ratio range, which does not require any additional control or actuating elements.

One advantageous embodiment of the apparatus according to the disclosure for blowing air into the flow channel can be produced simply, by providing the appropriate openings directly in the cast compressor housing parts. There is no need for any additional nozzle elements or compressed-air connections.

The compressed air is distributed between all of the plurality of blowing-in openings via an at least partially annular air channel, which is integrated as a cavity in the compressor housing.

BRIEF DESCRIPTION OF THE DRAWINGS

The apparatus according to the disclosure for blowing air into the flow channel of a radial compressor will be explained in more detail in the following text with reference to the drawings, in which.

DETAILED DESCRIPTION

Figure 1:
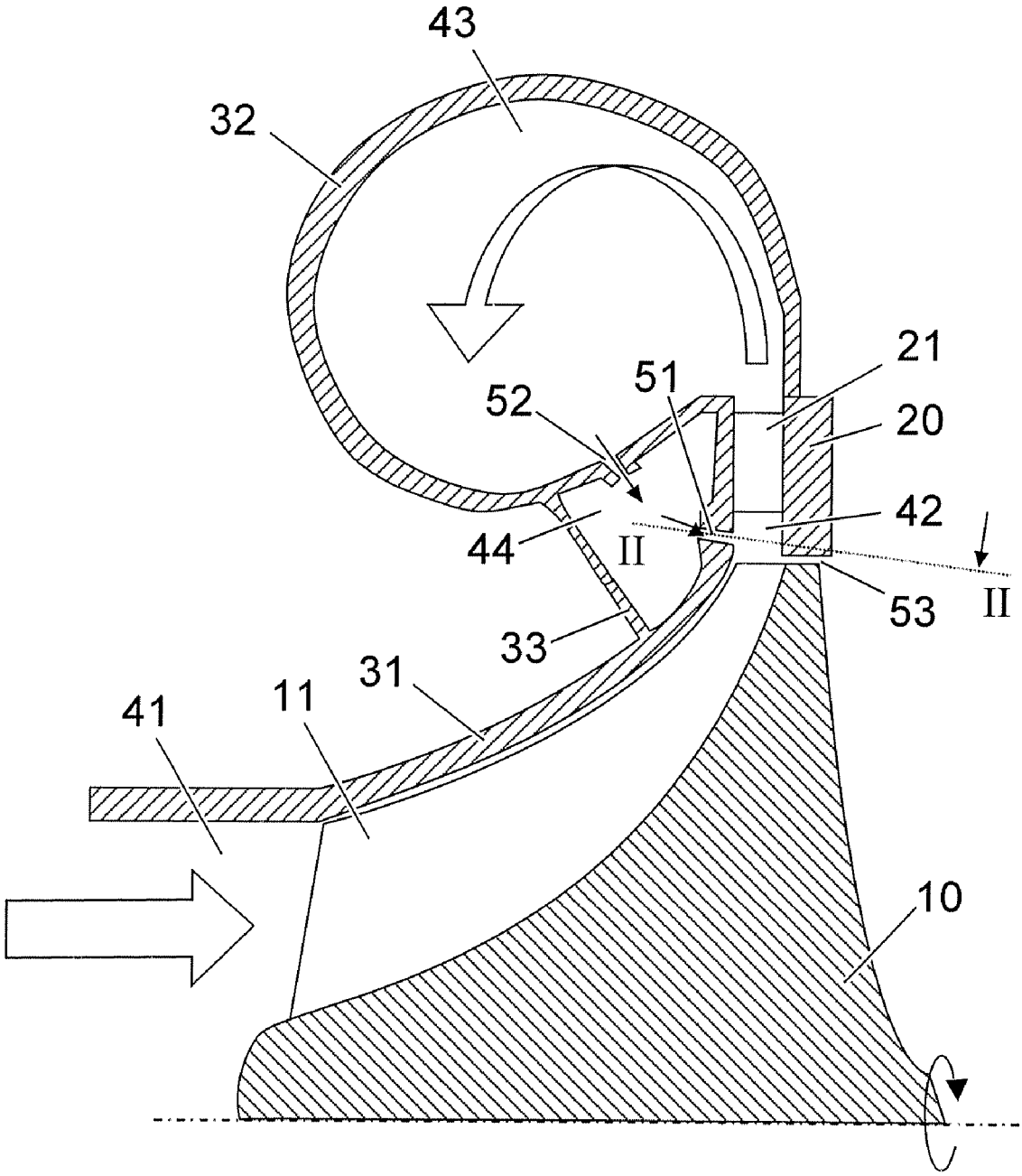
FIG. 1 shows a section through a radial compressor with an apparatus according to the disclosure for blowing air into the flow channel.

FIG. 1 shows a section through a radial compressor with a compressor wheel arranged on a shaft which is mounted such that it can rotate. The compressor wheel has a central hub 10, and rotor blades 11 arranged on it. The compressor wheel is arranged in the compressor housing. The compressor housing has a plurality of parts which bound the flow channel for the medium to be compressed. In the area of the rotor blades or of the compressor wheel, an inner compressor housing wall, the so-called insert wall 31, bounds the flow channel 41 radially on the outside. The flow channel is bounded radially on the inside in this area by the hub of the compressor wheel. Further downstream from the area of the rotor blades of the compressor wheel, the flow channel 42 is bounded on the side opposite the insert wall 33 by a diffusor wall 20. The diffusor has diffusor guide vanes 21 which are arranged in the flow channel. Further downstream from the diffusor guide vanes, the flow channel 42 opens into the manifold cavity 43 of the spiral housing 32, from where a line which is not illustrated passes to the combustion chambers of the internal combustion engine that is connected to the exhaust-gas turbocharger. The air flow is in each case indicated in the figures by the thick, white arrows.

The apparatus according to the disclosure for blowing air into the flow channel has a return air channel 44, which leads from the manifold cavity 43 downstream from the diffusor guide vanes 21 into the flow channel 42 between the rotor blades 11 of the compressor wheel and the guide vanes 21 of the diffusor.

Figure 3:
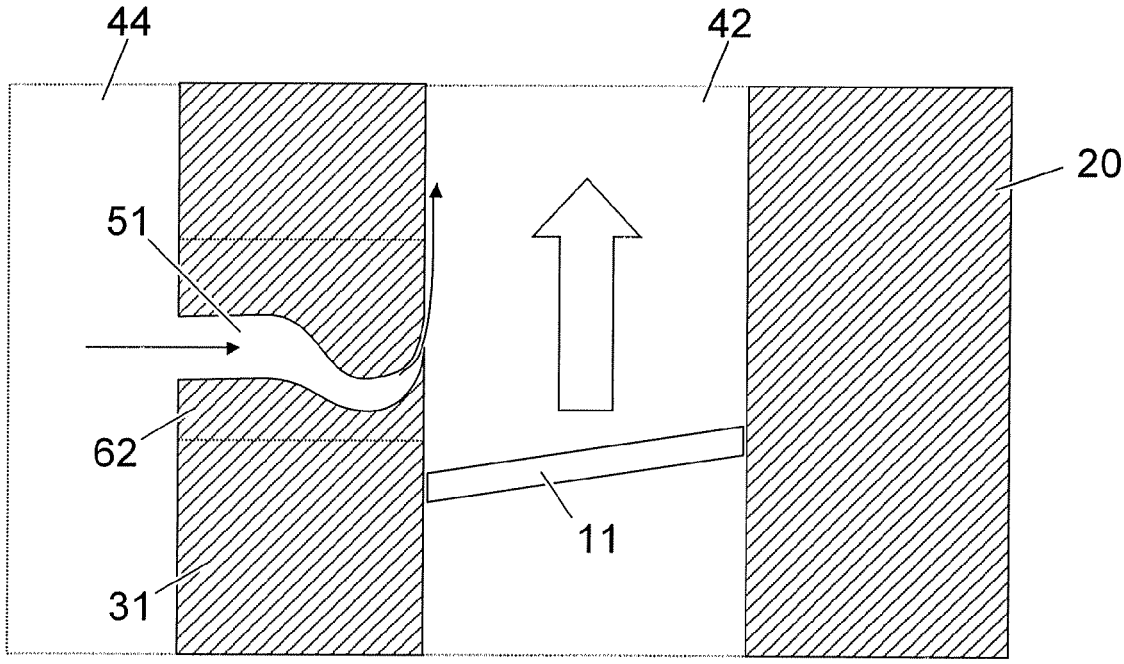
FIG. 3 shows a detail, illustrated enlarged, of the apparatus according to the disclosure as shown in FIG. 1, with an integrated nozzle element with an integral joint.

As illustrated in FIG. 1, the air channel 44 may be in the form of a cavity which is bounded by the insert wall 31, the spiral housing 32 and a separating wall 33 of the compressor housing. The air channel 44 leads from an extraction opening 52 in the compressor housing wall in the area of the manifold cavity 43 to a blowing-in opening 51 in the compressor housing wall in the area between the rotor blades 11 of the compressor wheel and the guide vanes 21 of the diffusor. The blowing-in opening 51, which opens into the flow channel 42 in the area between the rotor blades 11 of the compressor wheel and the guide vanes 21 of the diffusor, is not cylindrical, but has an inner Coanda surface structure. As is illustrated in an enlarged form in FIG. 3, this means that the compressor housing wall has a rounded area which projects into the blowing-in opening and along which the air can flow in accordance with the Coanda effect.

Figure 2:
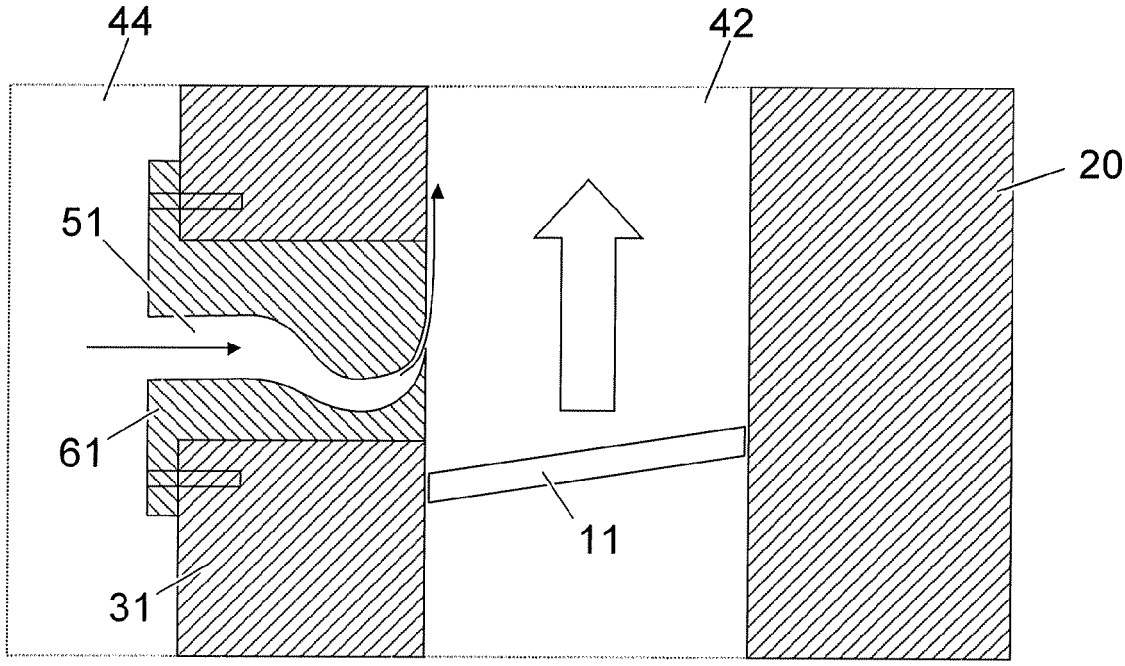
FIG. 2 shows a detail, illustrated enlarged, of the apparatus according to the disclosure and as shown in FIG. 1, with a nozzle element fitted.

On emerging from the area of the rotor blades of the compressor wheel, the flow in the flow channel has a major tangential component. The Coanda effect ensures that no major swirling or lateral flows occur when the air is blown into the flow channel. Instead of this, the air which is blown into the flow channel, likewise in the tangential direction, adheres to the rounded area of the blowing-in opening 51 and is introduced into the flow in the edge area of the flow channel, in the flow direction, as is indicated by the thin arrows in FIG. 2 and FIG. 3.

The air is blown into the flow channel passively, that is to say without any control or actuating elements. Because the pressure in the manifold cavity 43 is higher than that in the flow channel 42 in the area between the rotor blades 11 of the compressor wheel and the guide vanes 21 of the diffusor, this results in an equalizing flow.

A plurality of blowing-in openings 51 can be provided along the circumference of the flow channel, that is to say at the same radial height with respect to the turbocharger shaft. These can all be connected to a single annular, or at least partially annular, air channel 44. A plurality of extraction openings 52, can likewise be arranged along the manifold cavity 43 in the circumferential direction.

Instead of one annular air channel 44, it is possible to provide a plurality of air channel elements which are subdivided by radially running separating walls, and each of which supply one or more blowing-in openings 51 with air for blowing into them.

The openings in the apparatus according to the disclosure can be incorporated in the compressor housing parts while they are being produced. This can be done directly during the casting of the compressor housing parts, either by encapsulating prefabricated nozzle elements 62 in the housing wall or by connecting them to the housing wall with an integral material joint, or by the specific contour of the blowing-in opening being integrated in the casting mold itself. The prefabricated nozzle elements 62 are made from a material which forms a joint with the steel of the housing wall during the casting process, without itself being melted. Alternatively, the inlet openings and the blowing-in openings can also be introduced into the compressor housing walls at a later time.

It is also possible to provide nozzle elements 61 which are connected in an interlocking or force-fitting manner to the compressor housing wall 31. This makes it possible, for example, to retrofit already existing turbochargers with the apparatus according to the disclosure for blowing air into the flow channel.

In order to reduce the thrust load in the area of the compressor wheel rear wall, or as barrier air for oil sealing of the bearings by means of an overpressure, air can be taken from the compressor in the area downstream from the rotor blades of the compressor wheel. This so-called leakage flow 53 can in turn have a destabilizing effect on the compressor flow, thus shifting the surge limit in the direction of higher volume flows, thus leading to an undesirable reduction in the useful range of characteristics. The blowing-in process according to the disclosure makes it possible to rest the surge limit profile back to the profile without any leakage flow 53.

LIST OF REFERENCE SYMBOLS

10 Compressor wheel hub
11 Compressor wheel blades
20 Diffusor wall
21 Diffusor guide vane
31 Insert wall, Inner compressor housing wall
32 Spiral housing, Outer compressor housing wall
33 Separating wall
41 Flow channel, induction area
42 Flow channel, diffusor area
43 Manifold cavity
44 Air channel, cavity
51 Blowing-in opening
52 Extraction opening
53 Leakage flow opening
61 Nozzle element, fitted
62 Nozzle element, integrated in the housing wall

What is claimed is:

1. An apparatus for blowing air into a flow channel, which carries a main flow between a compressor wheel and a manifold cavity of a radial compressor, comprising at least one blowing-in opening which is arranged along a circumference of the flow channel and aligned tangentially with respect to a compressor housing wall of the compressor wheel, and which is provided with a Coanda structure and is in the form of a nozzle, and through which air can be blown in the tangential direction of the compressor housing wall into the flow channel between rotor blades of the compressor wheel and guide vanes of a diffusor, wherein in the compressor housing wall at least one extraction opening is incorporated in the area of the manifold cavity, and wherein the at least one blowing-in opening is connected via a channel to the at least one extraction opening.

2. The apparatus as claimed in claim 1, wherein the flow channel between the at least one blowing-in opening and the at least one extraction opening is in the form of an at least partially annular cavity running in the circumferential direction of the flow channel.

3. The apparatus as claimed in claim 2, wherein the cavity is bounded by compressor housing walls.

4. The apparatus as claimed in claim 1, wherein the at least one blowing-in opening is incorporated in the compressor housing wall which bounds the flow channel, and is formed by the compressor housing wall which bounds the flow channel.

5. The apparatus as claimed in claim 1, wherein the at least one blowing-in opening is formed by an integral or multi-part nozzle element, which is arranged in an opening in the compressor housing wall and is connected to the compressor housing wall.

6. The apparatus as claimed in claim 1, wherein the at least one blowing-in opening is formed by an integral or multi-part nozzle element, which is integrated, with an integral connection, in the compressor housing wall.

7. An exhaust-gas turbocharger, comprising: a radial compressor with an apparatus for blowing air into a flow channel of the radial compressor, wherein the apparatus for blowing comprises:

at least one blowing-in opening which is arranged along a circumference of the flow channel and aligned tangentially with respect to a compressor housing wall of a compressor wheel, and which is provided with a Coanda structure and is in the form of a nozzle, and through which air can be blown in the tangential direction of the compressor housing wall into the flow channel between rotor blades of the compressor wheel and guide vanes of a diffusor, wherein in the compressor housing wall at least one extraction opening is incorporated in the area of the manifold cavity, and wherein the at least one blowing-in opening is connected via a channel to the at least one extraction opening.

8. The apparatus as claimed in claim 3, wherein the at least one blowing-in opening is incorporated in the compressor housing wall which bounds the flow channel, and is formed by the compressor housing wall which bounds the flow channel.

9. The apparatus as claimed in claim 3, wherein the at least one blowing-in opening is formed by an integral or multi-part nozzle element, which is arranged in an opening in the compressor housing wall and is connected to the compressor housing wall.

10. The apparatus as claimed in claim 3, wherein the at least one blowing-in opening is formed by an integral or multi-part nozzle element, which is integrated, with an integral connection, in the compressor housing wall.

11. A method for blowing air into a flow channel, which carries a main flow between a compressor wheel and a manifold cavity of a radial compressor, comprising arranging a discrete number of blowing-in openings distributed along the circumference of the flow channel and aligned tangentially with respect to a compressor housing wall housing wall of the compressor, and which are provided with a Coanda structure and are in the form of nozzles, and blowing air in the tangential direction of the compressor housing wall into the flow channel between rotor blades of the compressor wheel and guide vanes of a diffusor, wherein in the compressor housing wall at least one extraction opening is incorporated in the area of the manifold cavity, and wherein the blowing-in openings are connected via a channel to the at least one extraction opening.

* * * * *